US006296598B1

(12) United States Patent
Boland

(10) Patent No.: US 6,296,598 B1
(45) Date of Patent: Oct. 2, 2001

(54) ABDOMINAL AND ARMS MUSCLES EXERCISE DEVICE

(76) Inventor: Kevin O'Brien Boland, 5623 Massachusetts Ave., Bethesda, MD (US) 20816

( * ) Notice: Subject to any disclaimer, the term of this patent is extended or adjusted under 35 U.S.C. 154(b) by 0 days.

(21) Appl. No.: 09/665,770

(22) Filed: Sep. 20, 2000

(51) Int. Cl.[7] ..... A63B 21/02
(52) U.S. Cl. ..... 482/126; 482/140
(58) Field of Search ..... 482/121–6, 140, 482/148, 112, 111, 128

(56) References Cited

U.S. PATENT DOCUMENTS 6,056,676 * 5/2000 Adams ..... 482/112

* cited by examiner

*Primary Examiner*—Jerome W. Donnelly
*Assistant Examiner*—Lori Baker Amerson
(74) *Attorney, Agent, or Firm*—A. R. Eglington

(57) ABSTRACT

A portable, lap-based multi-exercise device which includes a first pair of elongate parallel members forming a base component and defining a trough for receiving the lever end of a traveling spanner bar; a pair of pivotable, upstanding lateral side bars attached at their lower ends to the torso-oriented, longitudinal ends of the trough; a first cross bar is connected pivotally to the upper ends of the side members and is adapted to receive either manual or user chest exertion, while is translated to the upper end of the spanner bar which then moves outwardly in response to user exertion thereon. A second transverse bar is pinned to the outer end of the trough and provides a second set of manual grips adapted for moving the trough component arcuately towards the first cross members, thereby moving the spanner bar along the trough, to steady the device while user effort is being imposed on the latter component.

10 Claims, 6 Drawing Sheets

FIG. 1
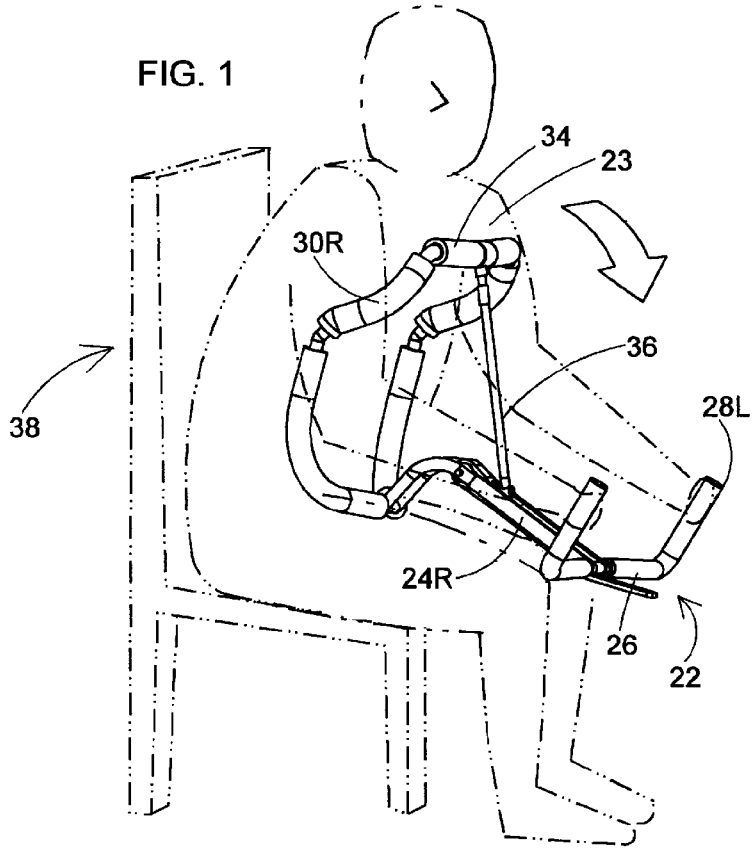
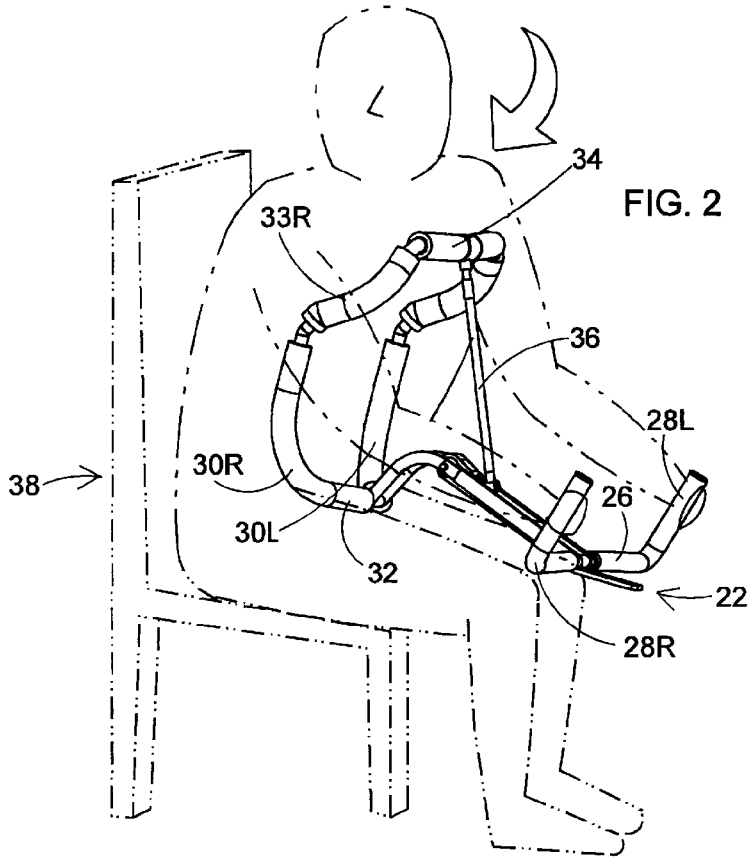
FIG. 2

ABDOMINAL AND ARMS MUSCLES EXERCISE DEVICE

FIELD OF THE INVENTION

The present invention relates to a portable exercise device adapted for selective human muscle conditioning and development.

BACKGROUND OF THE INVENTION

The need for practical and efficient devices suited for muscular toning and human body conditioning is a long established one. There are a variety of exercise devices, including powered machines, that selectively challenge different sets of body muscles. One area of sought exercise is directed to the abdominal, biceps, and triceps muscle sets. One such device described in the patent literature as is described in U.S. Pat. No. 5,232,425 (granted Aug. 3, 1993 to J. V. Miller et al). The Miller patent teaches a device that involves direct, progressive resistance to the user over the field of action. This means that during movement over the inherent range of motion for the prior art device, that its resistance level increases linearly, as opposed to a preferred constant plus consistent resistance level throughout the device range of motion.

Boland U.S. Pat. No. 5,759,138 (Jun. 2, 1998) and U.S. Pat. No. 5,964,685 (Oct. 12, 1999) are both directed to a lap-based exercise device for conditioning abominals and arms, with the later '685 patent disclosing an alternate embodiment entailing a resilient band tensioning means (FIG. 11), and providing an optional pivoting action for the upper cross bar member 70.

In the present embodiment of the Abs exercise machine, the user is now able to perform a crunch exercise as compared to the users of my earlier devices. Those provided more of an old fashioned style of sit-up exercises which was a combination abdominal/hip flexor routine.

The present embodiment of this device affords more of a concentrated abdominal workout without involving the hip flexor muscles.

In lying on the floor performing an old fashioned sit up, one raises their entire torso off the ground, which involves both the abdominal and hip flexor muscles. In the last 20 years, fitness trainers now recommend lying on the floor and raising only your shoulders off the ground, thereby isolating the abdominal muscles and intentionally neglecting the hip flexor muscles. The present embodiment takes this modern day approach referred to as a "crunch," so only the present device allows the "crunch" to be effected in the comfort of a chair without having to get on the floor to exercise.

In this new embodiment, an abdominal crunch workout is provided by the pivoting action afforded by a second set of blastomeric joints connecting the upper and lower pairs of generally vertical side bars.

Both U.S. Pat. No. 5,964,685 and this herein described new embodiment affords an oblique (side) abdominal workout by allowing the chest crossbar to pivot and twist. Patent '685 affords this pivoting just below the middle of the chest crossbar in component 89 shown in FIGS. 11 and 12 on patent '685. The new embodiment affords this same oblique abdominal workout except the pivoting action is afforded by two elastomer joints (upper set) at each end of the chest crossbar as in FIGS. 9 and 10.

Moreover, the present embodiment has fewer structural components, while providing some greater versatility, in that the crotch and chest nesting components are integrated. This permits pivoting on both sides of the chest high horizontal bar, and not centrally via elastic-type couplings. As a result of simplified fabrication, the present device is less costly to manufacture and market.

It is a principal object of the present invention to provide a portable abdominal (lower, upper and sides ABS) and arms exercise device that can be used alternately for abdominal toning and triceps muscle toning, by simple realignment of its operating position.

It is another primary object of the invention to provide an exercise device which incorporates the option of performing an added crunch exercise while reducing the number of structural components from that seen in the prior art devices.

It is still another object of the invention to provide a device employing a linkage-based system versus a direct resistance system yielding a lineal and consistent resistance throughout its range of motion.

A yet further object of the invention is to provide a portable unit that folds up for easy shipment and/or storage.

It is a still further object of the invention to provide a device which precludes the need for positioning of the hands adjacent the user's chest (as seen with Miller '425 FIGS. 11 and 12), rather by steadying the device just within the user thighs, thus making for a concise and focused abdominal exercise.

Another object of the present device is to angle the track and the machine in the user's lap, so that the user's forward motion against the crossbar resistance is downward, thereby increasing the "crunch" proper.

SUMMARY OF THE INVENTION

According to the present invention, there is provided an exercise device adapted to alternately condition abdominal muscles by relying on a rolling lever type of mechanism coupled with a linkage-based, counter resistance means, which configuration allows for a consistent and smoother range of motion for the exerciser. The new device includes a transversely-oriented first member proximal to the inner lap of the device user, and is centrally pinned to an elongate first pair of rigid parallel members, serving as a lap-based component, the first parallel pair also define a recessed, elongate trough, which receives pivotally therein, one longitudinal end (lower) of a rigid single spanning bar and its associated tensioning means; the other longitudinal end (upper) of the spanning bar is pivotally pinned to an upper cross-bar, which cross bar is itself mounted straddling an upstanding second pair of spaced-apart, elongate members being anchored at their lower longitudinal ends to the lap-engaging, longitudinal ends of the elongate first pair of members.

At the outer (distal) longitudinal end of the lap-based, first pair of members, there is centered a third elongate, rigid cross bar, which cross bar further preferably includes a set of manually grippable means for activation of the exercise device, while the same device is supported in the seated user's lap, and is resting against his chest. The grippable means themselves comprise upwardly-oriented, opposing terminal segments of the distal horizontally-aligned bar.

As noted, the single spanning bar terminates within the trough of the first pair of parallel members and is, at its lower end, adapted to affect reciprocal linear movement therein, by responding to user's exertion made on the gripping bars in a gap-closing direction. The spanning bar lower end is functionally tied to a horizontally-aligned, tensioning band, which band provides the counter force (resistance level) to the user's force being exerted on the grippable means over the device range of motion. An alternative means for the counter force would be a hydraulic cylinder on a spring-based device.

The chest high, transverse member is preferably provided with a pair of sleeve-type cushion elements that serve to ease the compression force on the user's chest, occurring while user is exerting either a crunching, or performing a triceps extension exercise.

The lap-based (centered) first pair of parallel members are each further provided with a linear channel disposed lengthwise of its inner surface, with the resulting opposing channel thus presenting a running track for a roller-mounted short crossbar, which cross bar is pinned to the lower end of the spanning bar, so as to engage same in a sliding manner. This form of resilient flexible linkage for the spanning member permits it to move reciprocally within the device trough, in response to the countervailing forces, being first exerted on such spanning member by the operatively attached elastic band and concurrently, but intermittently, by the upstanding second cross member. This translation is effected when the linked crossbar that is chest-side is swung arcuately toward the hand grippable cross member on the outer end by an exerciser, thus moving the spanning bar lower end outwardly in counter direction to the elastic band tension.

The pivoted upper lateral segments comprise the components that bracket and brace the transverse member, affording the abdominal oblique workout. A second and lower set of pivots are provided which permit conduct of the crunch exercise.

Generally, the strengthening of abdominal is afforded by the user's gripping of the handle ends of the distal cross-member, and then chest pushing the upper cross member (resistance bar) in a downward arc range of motion toward the user's closed lap sides (see FIG. 1). Similarly so, with the oblique exercise, the user alternately leans with each shoulder towards the middle. While the abdominal and biceps workups have a reciprocal range of motion, for the triceps exercise, the device itself is slid slightly down the user's thighs and then the user grabs the chest crossbar with his hands and pushes forward against the crossbar, thereby pushing the spanner bar and elastic tensioning band, thereby performing the triceps extension exercises. Thusly, this single device is adapted to serve to provide toning for the abdominal, upper, lower, obliques, and triceps muscle sets.

SUMMARY OF FIGURES

FIG. 1 is a schematic perspective view of an male exerciser (in phantom) employing the present device in a crunching (abdominal) exercise;

FIG. 2 is another perspective view of the exercise device shows the oblique workouts with a twisting crossbar (in phantom) employing the similarly aligned present device;

DETAILED DESCRIPTION OF PREFERRED EMBODIMENT

Figure 3:
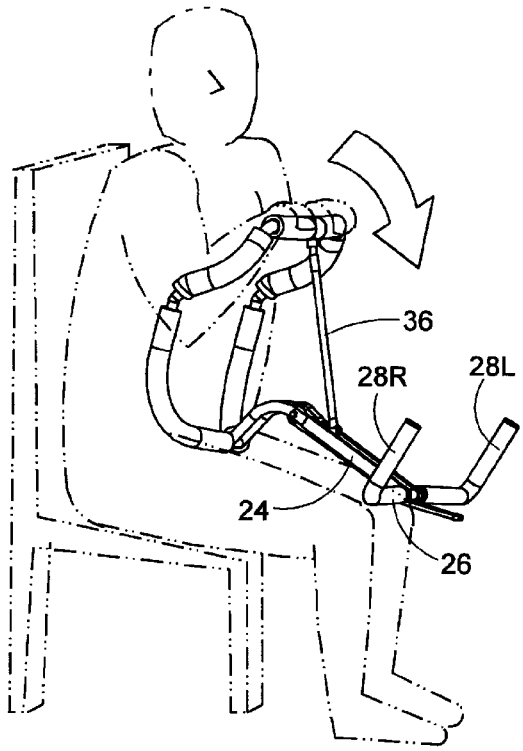
FIG. 3 is another perspective view of the exercise device (in phantom) of the exercise employing the device, in a differently aligned mode, for a triceps positioning exercise.

While the present invention is susceptible to some modifications so to effect the pre-tensioning aspect of the preferred embodiment, it will be described in detail. It should be understood, that there is no intention to limit the depicted invention to the particular structure which is described here in detail, but it is intended to embrace modified constructions and functional equivalents falling within the scope of the appended claims.

Referring now to the drawing, as shown in each of the schematics of FIGS. 1–4, it is an ABS and Arms exercise device. In each view, the device is engaged by an exerciser. It includes: the portable lap-positioned device, generally 22, having a lap-supported, elongate, linear pair of sidewall members 24L/R; a distal, elongate cross-member 26 with terminal upswept handles, 28U/R; a lower elongate crossbar 32 (tucked into the exerciser's lap); an upstanding pair of linked support members 30L/R; an upper elongate crossbar 34 for bracing members 30, which rests against the upper torso; and an inclined spanner-bar 36, which is functionally linked between the upstanding transverse member 34 and a device tensioning mechanism (not seen), conveniently located in the trough between members 24L/R. The user is necessarily seated on a chair 38 while exercising. Note that in FIG. 1, the user's palms should be oriented appropriately to maintain the lap position for the device 22 during chest exertion downwardly.

In FIG. 1, the user is engaged in a leaning, forward motion, while his upper torso 23T pressures crossbar 34, concurrently with his bracing of the manually-grippable handle bars 28L/R, thus retaining the device frame static, while it is being activated in the lap of the user. The arcuate/reciprocal range of motion stresses and conditions primarily the abdominal muscles, during the "crunching" effort, and its complemental return to upright mode (which is effected through several repetitions). In FIG. 2, note the user is gripping member 34 for conduct of the bar twisting exercise.

In the schematic of FIG. 3, the hands are aligned as in FIG. 2, so as to permit the triceps extension exercise by downward exertion. While the abdominal and biceps workups have a reciprocal range of motion, for the triceps exercise, the device itself is slid slightly down the user's thighs and then the user grabs the chest crossbar with his hands and pushes forward against the crossbar, thereby pushing the spanner bar and elastic tensioning band, thereby performing the triceps extension exercises. Thusly, this single device is adapted to serve to provide toning for the abdominal, upper, lower, obliques, and triceps muscle sets.

In all of the described exercises, the manual effort upon either cross member in the defined arcuate range of motion, causes spanning bar 36 to move along a track-follower assembly (to be described), against the countervailing tension imposed thereon by an operatively-connected tensioning band (also to be described). In all exercises, upon manual release, the follower assembly returns to its at-rest position, as defined by the substantially unstretched length of an associated tensioning band, or by any equivalent resilient tensioning structure (not depicted).

Figure 4:
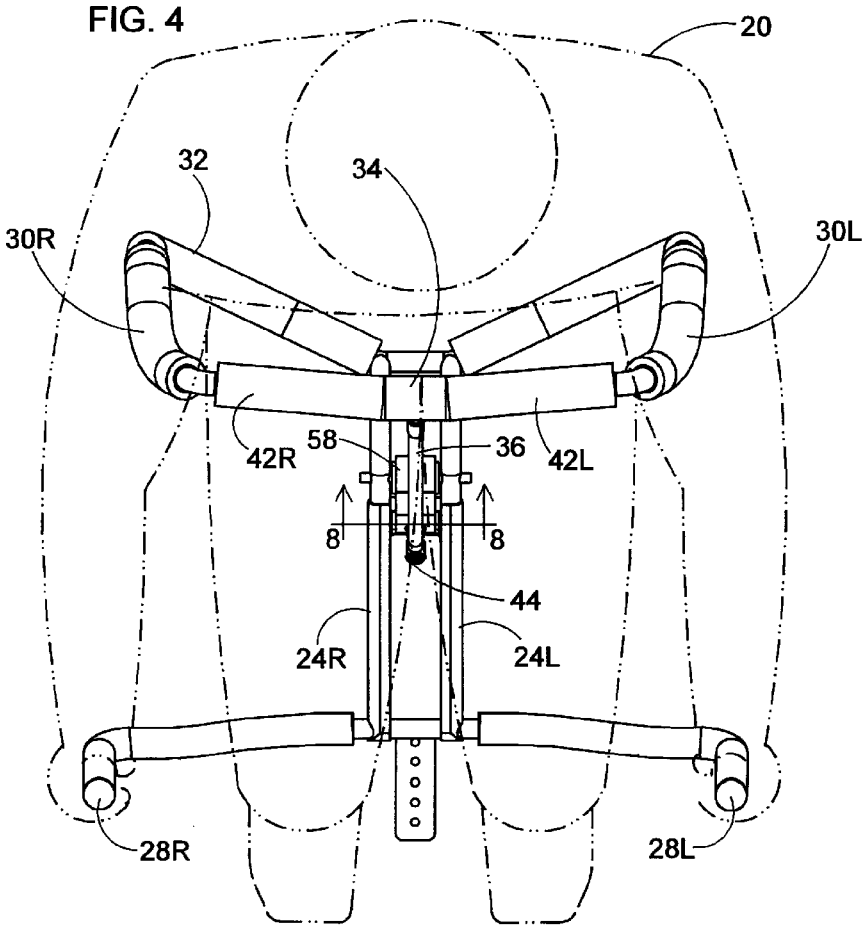
FIG. 4 is a top plan view of the present device (enlarged for clarity) aligned as in the exercise figures FIG. 1/2.

The top plan schematic view of FIG. 4 (enlarged for clarity) depicts the user engaged with crossbars, 42L/R, and about to start the abdominal crunch motions. The paired upstanding members, 30L/30R,are seen as somewhat to be secured at their upper ends to padded crossbar 34, which transverse bar is further provided with cushioning sleeves, 42L/R, for minimizing pressure discomfort on the upper chest. Central spanner bar 36 is seen with its lower longitudinal end attached to a track-follower assembly 44, which assembly is composed of an operatively attached, outer-end rollers, 76A/B (FIG. 8). As is apparent, assembly 44 moves reciprocally within a longitudinal trough 57 of dual member 24 (not seen) responding to the imposed movement on spanner bar 36; which bar, in turn, responds to partial arcuate closing of the space between distal handles, 28L/R, and cushioned upper cross member 34. The upper end of spanner bar 36 is provided with an elastomeric sleeve joint. Lower cross member 32 is tucked into the crease (crotch) between the user's lap and his torso for device stability and action. The two parallel bars exiting and converging from the track towards the user's crotch are the members which afford the "jacking up" of this device.

Figure 5:
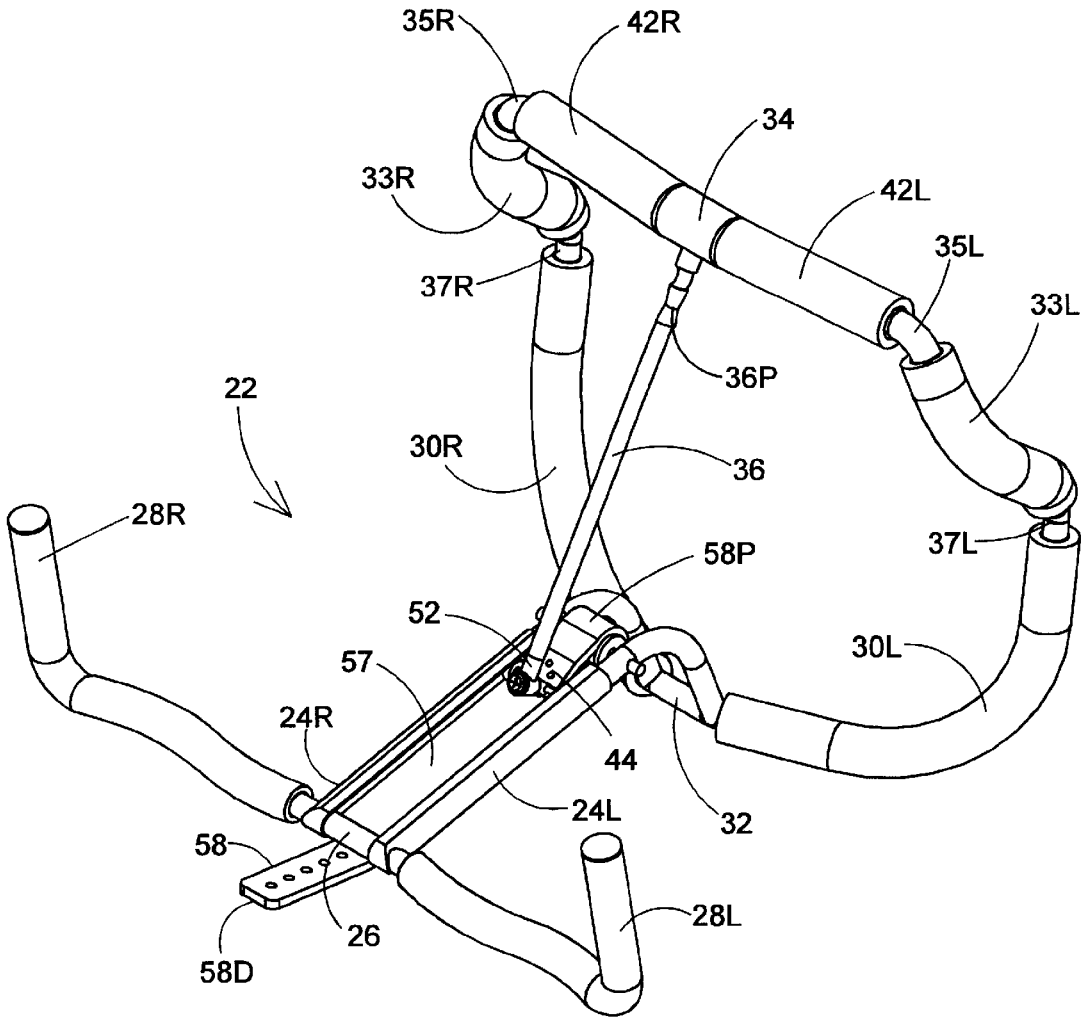
FIG. 5 is a perspective view of the present device as aligned for use in the exercises of FIG. 1/2, and now seen from the frontal side normally distal from the users chest.

The perspective view of FIG. 5 shows the exercise device 22, standing alone, as it would be spatially-oriented to conduct either of the crunching or curling exercises, shown in FIG. 1. The upper end of sloped spanner bar 36 is centrally attached to transverse member 34, and is adapted to pivot on it as the latter bar tracks within trough 57. The lower longitudinal end 52 of spanner bar 36 is likewise adapted to pivot at its lower longitudinal end. Spanning bar lower end 52 is linked to follower assembly 44, which is positioned transversely of the spaced-apart, parallel sidewalls, 24L/R. Crossbar 34 is connected to upper side members, 33L/R, via pivoted joints, 35L/R, respectively. Joints 35L/R provide a horizontal pivoting action. Side members, 33L/R, are connected to the lower side members, 30L/R, via pivoted joints, 37L/R. Each of these joints comprise a preformed elastomeric sleeve. Also, lower joints 37L/R provide a vertical pivoting action. The opposing inner surfaces of paired sidewalls, 24L/R, are each provided with a linear channel, 56L/56R (see FIG. 8), which channels are slidingly engaged by the outer-end rollers, 76A/B, of follower assembly 44. Assembly 44 is preferably configured as a bracket-type platform, with laterally aligned upstanding lugs, that accommodate the axle (not seen) of roller set, 76L/R, within assembly 44. Disposed longitudinally in the proximal segment of trough 57 is a horizontally-aligned resilient tensioning band 58.

Band 58 is secured at its proximal end (torso-side) to the upper segment of assembly 44. The band is secured at its other distal longitudinal end 58D (detachably) to the under-surface (not seen) of trough 57, reversing direction over rotating spool 68 (See FIG. 11). In an unextended position, band 58 is sized to define the preferred initial intermediate tension position for follower assembly 44, when not driven to tracking within the dual sidewall channels, 56L/R, of elongate paired member 24. As the spaced-apart handles, 28L/R, are drawn toward upper cross bar 34, this causes spanning bar 36 to bias its lower end 52 outwardly, driving associated follower assembly 44 towards distal cross bar 26, but concurrently doing so against the limiting counter-tension imposed by the stretching of resilient band 58. Clearly, the crunching exertion on the distal member 26 are relaxed, as the spanning bar 36 draws the follower assembly 44 backward to its at-rest position, as is depicted.

Figure 6:
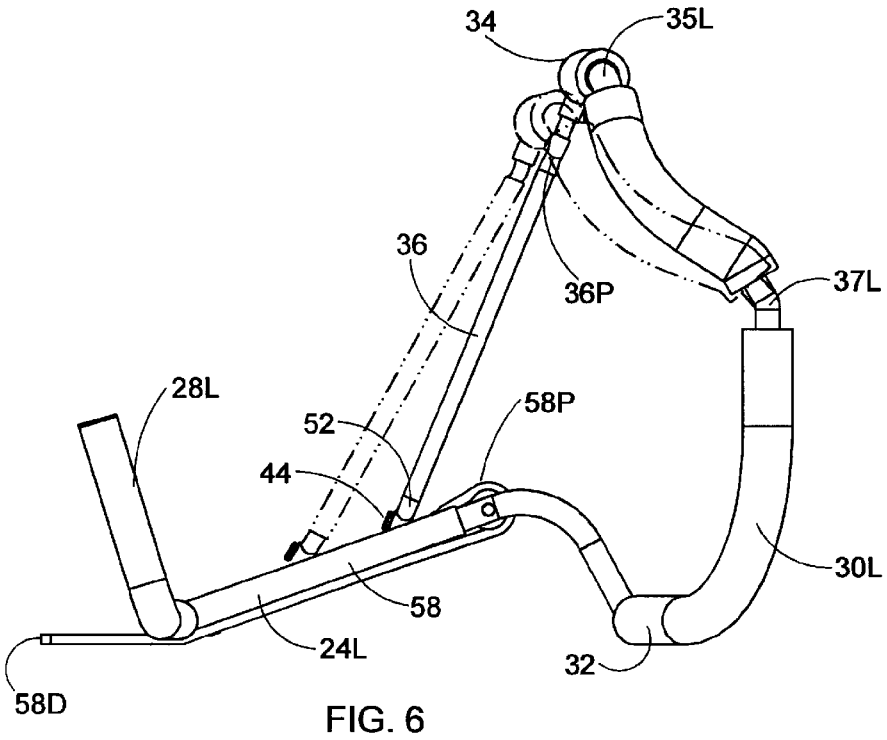
FIG. 6 is a side elevation view of the device of FIG. 5, standing alone.
Figure 7:
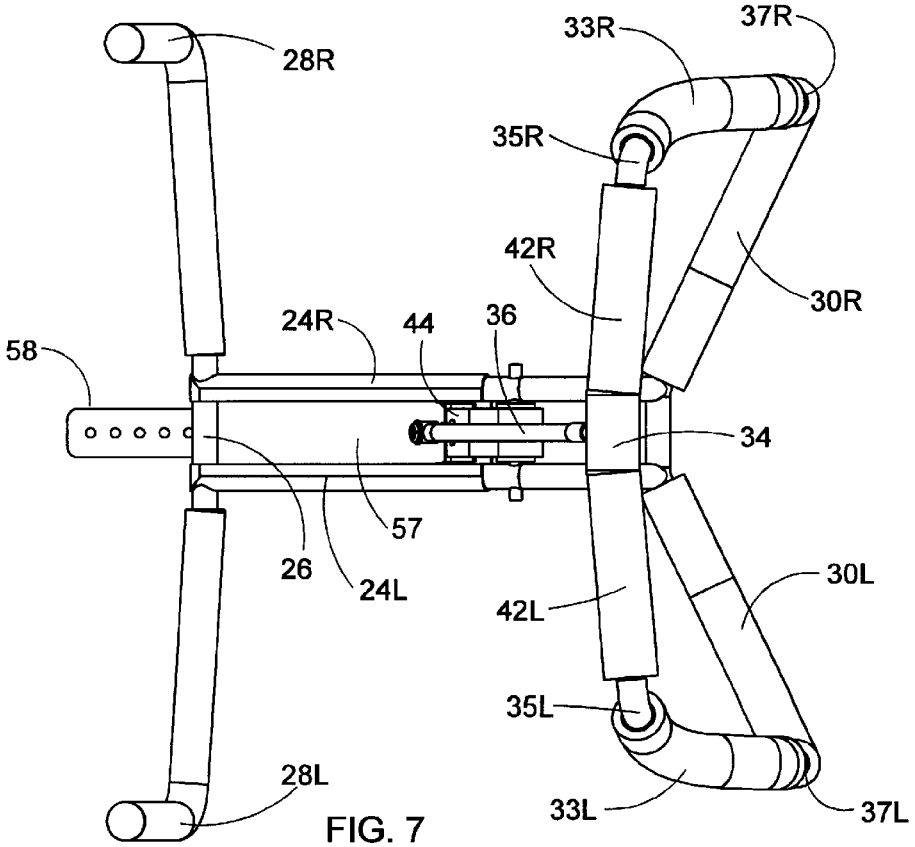
FIG. 7 is a top plan view of the device of FIG. 6, also 5 standing alone.

FIGS. 6 and 7, are shown side elevation and top elevation views, respectively, of the inventive device, standing alone, (spatially oriented for the curling exercise) but further depicting the operative, reciprocating, tensioning linkage, which provides the uniform resistance needed for the effective use of the device in varied muscle set conditioning. The pivoted upper segments, 33L/R, conveniently also bowed, are the components that bracket and brace transverse bar 34. The flexible linkage between respective side members 33L/R, are the pivoted joints, 35L/R, to cross member 34, respectively. The top pair of joints permit an oblique abdominal workout. Similarly, the linkage between members 33L/R and members, 30L/R, are pivots 37L/R. This pivoting action permits conduct of the crunch exercise. The upper pair of pivoted brackets 35L/R serves to permit a second pivotable movement wherein the twisting of the chest crossbar work the obliques.

Figure 8A:
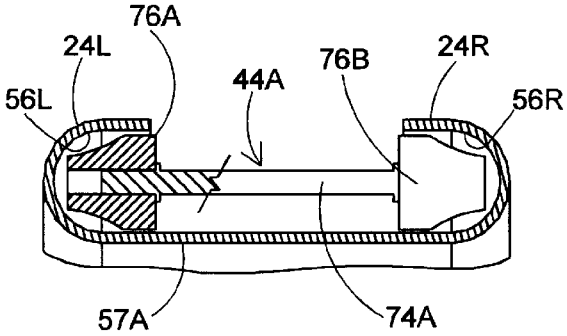
FIG. 8A is a transverse sectional view, taken along lines 8—8 in FIG. 4 (spanners and band chassis omitted for clarity), depicting a first embodiment for the opposing sidewall, dual channels that define the moving track for a reciprocating track-follower assembly, roller components being shown.
Figure 8B:
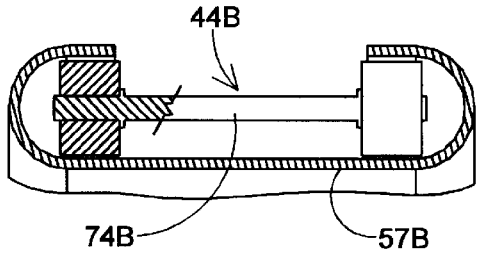
FIG. 8B is a second transverse vertical sectional view, depicting an alternate configuration for a unitary trough member.
Figure 8C:
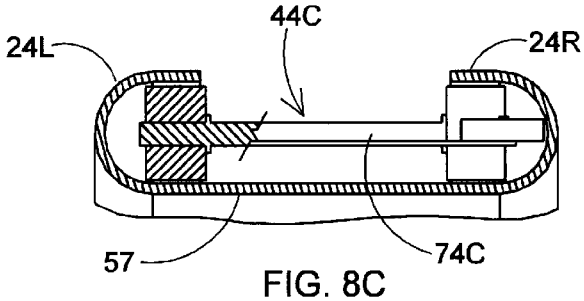
FIG. 8C is a third sectional view for an alternate channel tracking mechanism.

The transverse vertical sectional view of FIG. 8A, of the follower itself 44A, which roller mechanism functionally moves (reciprocally) between the elongate member sidewalls, 24L/R. It better depicts the operative roller components, omitting spanner member 36. It depicts the opposing linear channels, 56L/R, recessed in member sidewalls 24L/R, tracking rollers 76A/B, axle support bracket 60, and bolted tensioning band 58. These channels provide the trackage for the roller assembly as it is driven outwardly by driven spanner bar 36.

The transverse sectional views of FIG. 8A also depicts the linkage point between longitudinal lower end 52 of spanner bar 58 and the spindle 74 of roller assembly 44A. Spindle 74A is functionally connected to a pair of roller bearings, 76A/B, which serve as the motive components of the tracking assembly 44 of FIG. 7. The function of tapered rollers is to provide a smooth and steady tracking motion for the abdominal oblique exercise.

Figure 9:
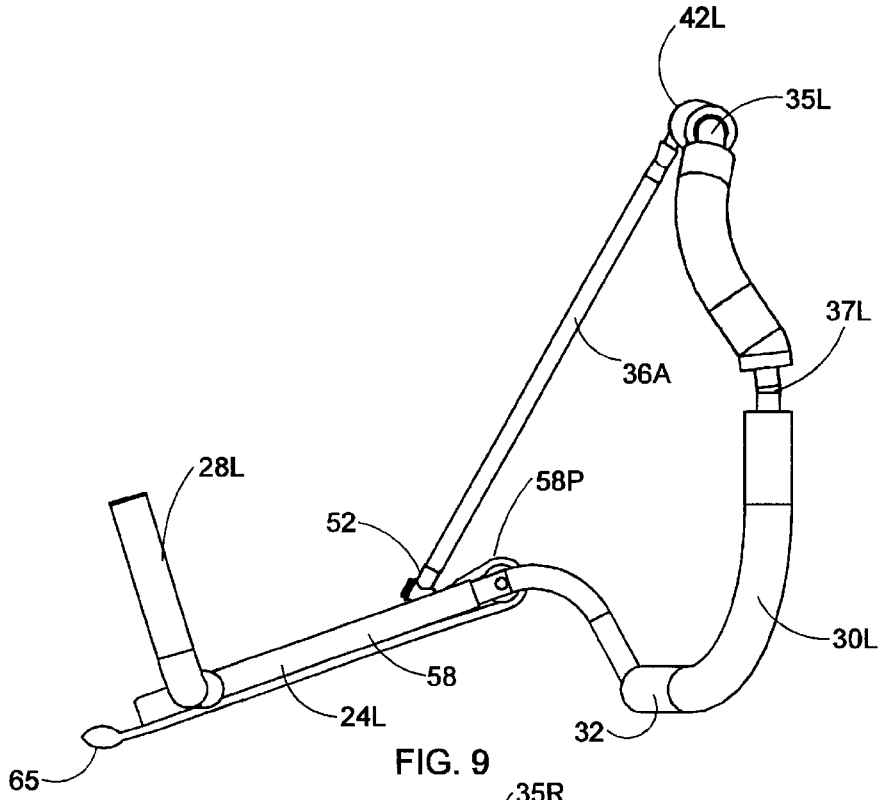
FIG. 9 is a side elevational view of the device of FIG. 10, standing alone, of an alternate embodiment.

The conditioning advantage of the present invention over the abdominal-limited exercise device of Miller ('425) is shown in FIG. 9 of my U.S. Pat. No. 5,759,138. The ideal constant resistance level is plotted diagrammatically, as resistance level vs. range of torso motion for the crunching exercise of FIG. 1. The linearly increasing resistance level of the prior art device is also plotted. The variable resistance level of the present embodiment, as plotted, shows it to approach, and follow broadly, a constant and desired resistance level. This operating feature fosters smoother and more uniform repetitions for the abdominal exercise, in particular, as compared to the prior art device.

Figure 10:
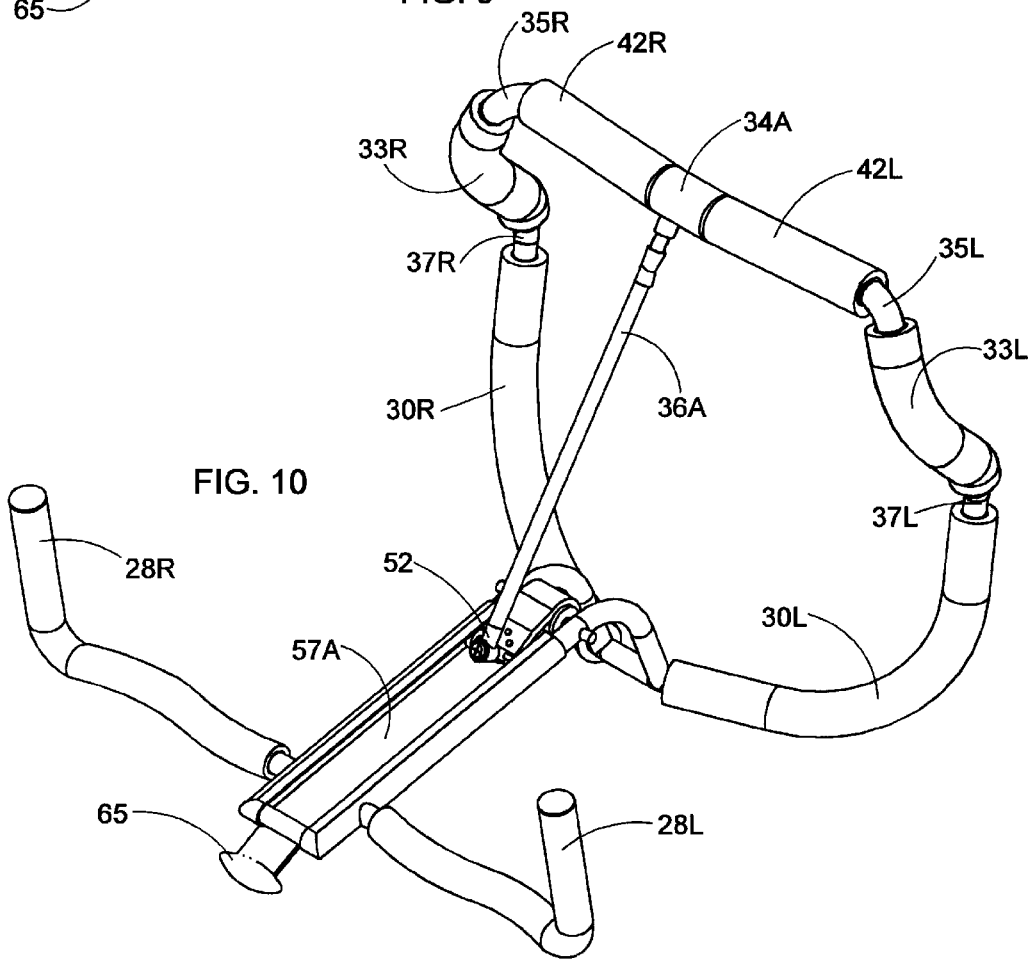
FIG. 10 is a perspective view of the alternate embodiment of FIG. 9, which is much like that depicted as in the perspective view of FIG. 5 for the first embodiment, but now with modified dimensions.

The perspective view of FIG. 10 is to an alternate embodiment of the invention, and is comparable in structure, to the first embodiment of FIG. 5. However, in this second embodiment, there is a longer track, 57A, and a longer spanner bar, 36A, to retract the cross member 32A towards the user chest. The knee bar (cross bar 26) is no longer at the distal end of the track 57A, but is positioned about two inches down the track. The other distinction is that with a higher vertical orientation, providing a 90° angle, the user (not seen) is no longer leaning forward to engage one's chest, as depicted in FIG. 1, an outwardly oriented, support leg 65 to pinned to the distal outer end of track 57A.

Figure 11:
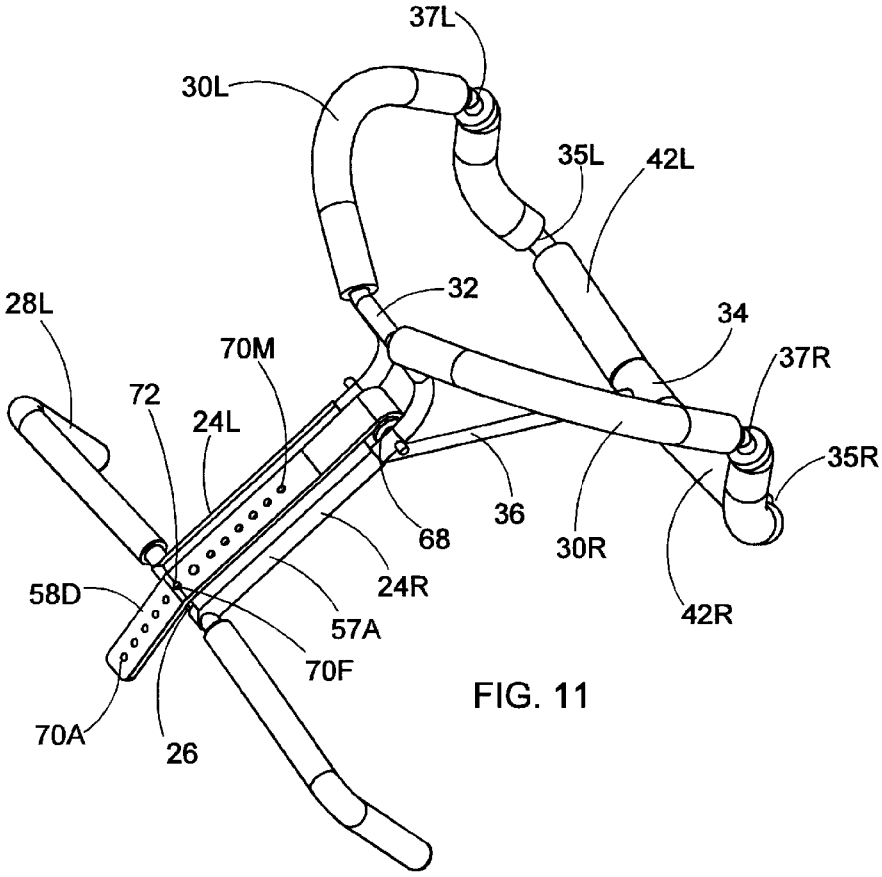
FIG. 11 is a perspective view of the first embodiment of FIG. 5, better depicting the pivoting axes in the crossbar (and side bar) subassembly.

In the perspective view of FIG. 11, the device has been turned over to reveal the linkage of the underlying tensioning means 58, which winds about a conventional rotatable spool 68, mounted transversely at the inner end of trough 57, and proximal to the inner ends of parallel members, 24L/R. As described earlier, the proximal longitudinal end of resilient band 58 is pinned to the follower assembly 44 (see FIG. 5). The opposing longitudinal end of band 58 extends the full length of the undersurface 57A (FIG. 8A) of the trough and then beyond, also as depicted in either of FIGS. 5 and 7. Band 58 is provided with a linear array of perforations, 70A–M, which are sized and adapted to be displaceably anchored to the trough underside. This anchoring is effected by providing a hooked detente 72, which is mounted fixedly on the undersurface 57A, and which is positioned distally of the torso and also adjacent to handle bar, transverse member 26. In the view, detente 72 is hooked to perforation 70F.

At the opposing band end, 58P is tied to roller assembly 44, on the upper surface of trough 57. The larger the number of perforations,70, which extend outwardly from the anchor point 72, then the greater is the inherent initial resistance provided by band 58 to movement of members 28L/R. With trial and error, the device users determine their preset initial tension; such is adapted to the widely variable torso and/or arms strength of the device user.

As the exercise of either FIG. 1 or FIG. 2 are effected, the arcuate closing gap, between chest bar 34 and distal cross bar 26, increases the resistance to the muscular effort as the track follower assembly 44 moves outwardly, and when muscle strength limit is reached, the assembly 44 itself is held intermediate the trough ends. Upon user release, the inherent band 58 resiliency permits the follower assembly to return to its at rest, but still somewhat tensioned, position, as is depicted in FIG. 5–11.

What is claimed is:

1. A multi-functional, portable, lap-based exercise device comprising:

(a) a first pair of spaced-apart, elongate parallel members defining a substantially uniformly, linear trough which has a proximal-to-the-user torso first longitudinal end and a distal second longitudinal end;

(b) a linear channel disposed lengthwise of the inner surface of each of the opposing first pair and both serving to provide a dual channel track;

(c) a first rigid cross strut which straddles the linear trough and being located variably therein between the parallel members of the first pair;

(d) a lower first transverse member secured centrally thereof to the inner longitudinal ends of the parallel members and which first transverse member has opposing arcuate intermediate segments that extend upwardly, which segments are substantially parallel, and with the upper longitudinal ends thereof arrayed for straddling the chest of the device user;

(e) an upper second transverse member secured at the longitudinal ends thereof to the upper longitudinal ends of the first transverse member;

(f) a single rigid spanning bar connected pivotally at the upper longitudinal end thereof to about the midpoint of the upper second member with said bar being anchored functionally at the lower longitudinal end thereof to the first cross strut;

(g) a third transverse cross member secured transversely of the distal second longitudinal ends of the first pair of parallel members, and adapted to provide a manually grippable means, serving to activate the exercise device;

(h) a track-follower assembly pivotally attached to the first strut, and being secured centrally thereof, which assembly operatively traverses the dual channel of said first pair of members, as driven by the second transverse member; and, (i) a variably connectable, axially-movable, resilient tensioning band with the distal band segment thereof, being anchored at one longitudinal end to the track follower assembly and with the proximal band segment being anchored at its other longitudinal end to a point intermediate of undersurface of said linear channel of the first pair; and, whereby upon drawing inwardly the second transverse member along an inherent arcuate range of motion towards the third transverse member in the second member thereby moves the track follower assembly somewhat distally against the counter bailing tension imposed thereon by the tensioning band, and upon user release of the second member, such conversely permits the track follower assembly to return to its at rest position.

2. The device according to claim 1 wherein the second cross member is provided with arcuate bowing along the intermediate segments thereof.

3. The device according to claim 1 wherein the track-follower assembly is provided with a laterally aligned, pair of roller means, which roller means traverses the linear channels of said first pair of parallel members.

4. The device according to claim 1 wherein the second transverse member is provided with sleeve-like cushion elements.

5. The device according to claim 1 wherein the third transverse member is provided with upwardly oriented, longitudinal ends configured for manual gripping.

6. The device according to claim 1 wherein the tensioning band is located partially within the trough defined by the first pair of parallel members, as to its distal longitudinal segment, and is concurrently being located partially within the transverse gap defined by the upstanding, second pair along the under surface of the elongate trough; for its proximal longitudinal segment.

7. The device according to claim 1 wherein the tensioning means comprises a resilient, generally planar strap, having a linearly-aligned array of perforations adapted to be engaged intermittently with an anchor detent on the undersurface of the trough segment bridging the parallel members and located intermediate the ends thereof.

8. The device according to claim 1 wherein the linear length of the channel track and of the spanner bar are both extended such that the upper second transverse member presents a substantially right angle orientation relative to the channel track, causing the second member to orient more at rest proximal to the chest of the user in the un-distended mode.

9. The device of claim 1 wherein the first transverse bar is connected pivotally to the adjoining upper side bars.

10. The device of claim 1 wherein the upper side bars are connected pivotally to the adjoining lower side bars.

* * * * *